United States Patent [19]

Abrams

[11] 3,966,103

[45] June 29, 1976

[54] HOLDER FOR CONTAINERS AND NAPKINS

[76] Inventor: Hyman Abrams, P.O. Box No. 27, N. Hackensack Station, River Edge, N.J. 07661

[22] Filed: Dec. 13, 1974

[21] Appl. No.: 532,620

[52] U.S. Cl. ..... 224/48 R; 211/51; 248/504; 206/74

[51] Int. Cl.[2] ..... A47G 23/06

[58] Field of Search ..... 224/48 R, 48 W, 48 A, 224/48 C, 48 F, 45 N; 211/52, 51, 50, 74, 72, 129, 126, 77; 248/504; 206/216, 74

[56] References Cited

UNITED STATES PATENTS

| | | | |
|---|---|---|---|
| 1,270,095 | 6/1918 | Bachr | 224/48 A |
| 1,992,657 | 2/1935 | Fontan | 224/48 A |
| 2,078,650 | 4/1937 | Clark | 224/48 R |
| 2,530,231 | 11/1950 | Detweiler | 224/48 A |
| 2,597,407 | 5/1952 | Thompson | 224/48 R |
| 2,776,756 | 1/1957 | Allan | 224/48 R |
| 3,047,329 | 7/1962 | Gunderson, Jr. et al. | 224/48 R |
| 3,331,515 | 7/1967 | Lange | 211/77 |
| 3,473,672 | 10/1969 | Fincher | 211/51 |

*Primary Examiner*—Robert J. Spar
*Assistant Examiner*—Kenneth Noland
*Attorney, Agent, or Firm*—Sherman & Shalloway

[57] ABSTRACT

A holder is provided for both supporting and carrying napkins and containers, such as condiment bottles. The holder includes a lower tray for napkins and an upper tray supported thereabove on struts for containers. The struts are constructed with vertically extending slots in which a retaining bar is received to rest upon the napkins and hold them securely in place. A handle extends above the upper tray to provide means for readily transporting the tray, while at the same time providing structure to engage and help support the containers. Flanges are provided around the perimeter of the upper and lower trays to assist in holding the containers and napkins in place.

6 Claims, 3 Drawing Figures

HOLDER FOR CONTAINERS AND NAPKINS

BACKGROUND OF THE INVENTION

1. Field of the Invention

This invention relates to holders for dining accessories; more particularly, this invention relates to holders for condiment containers and napkins.

2. General Considerations and Prior Art

In organizing a table for dining, it is usually desired to provide condiments and napkins. It is also desirable to remove the condiments and napkins from the table after a meal is finished in order to readily wipe the table off and perhaps substitute some type of decoration such as a plant or the like. In addition, condiments and napkins are often needed in different locations such as outside at a barbecue pit or on a picnic table or perhaps at the kitchen stove. Restaurants also need to readily transport condiments and napkins from table to table and from service areas to eating areas. In these various exemplary situations, it is desirable that the condiments and napkins be organized in a convenient fashion, wherein they may be readily transported together and readily dispensed. Any structure for accomplishing these ends should be esthetically appealing, while providing sufficient support so that the condiments and napkins will not fall out while being carried.

The prior art includes the following patents: U.S. Pat. No. Des. 178,655; U.S. Pat. Nos. 1,550,544; 1,583,293; 1,647,000; 2,539,600; 2,511,066; 2,651,420; 3,146,906; 3,442,393; and 3,473,672. These prior art patents do not disclose holders which meet the aforementioned needs.

OBJECTS OF THE INVENTION

In view of the afore-mentioned considerations, it is an object of this invention to provide a new and improved holder for condiment containers and napkins.

It is an additional object of this invention to provide a new and improved holder for condiment containers and napkins which is both attractive in appearance and provides support for the condiment containers and napkins while they are being transported.

It is still another object of the instant invention to provide a holder for condiment containers and napkins which is versatile and may be used in a variety of situations.

It is a further object of the invention to provide a new and improved holder for condiments and napkins, wherein the condiments and napkins are positively held on the holder, yet are readily dispensed therefrom.

SUMMARY OF THE INVENTION

In accordance with these and other objects, the instant invention contemplates a unitary structure for holding and dispensing containers and napkins which includes a lower tray portion for receiving a stack of napkins and strut means extending from the lower tray portion to an upper tray portion which receives containers. A handle projects above the upper tray portion to a height greater than the containers and provides a means for carrying both the containers and napkins simultaneously. The strut means has slots therein for receiving a bar which serves as a weight to hold the napkins in place.

DESCRIPTION OF THE PREFERRED EMBODIMENT

Figure 1:
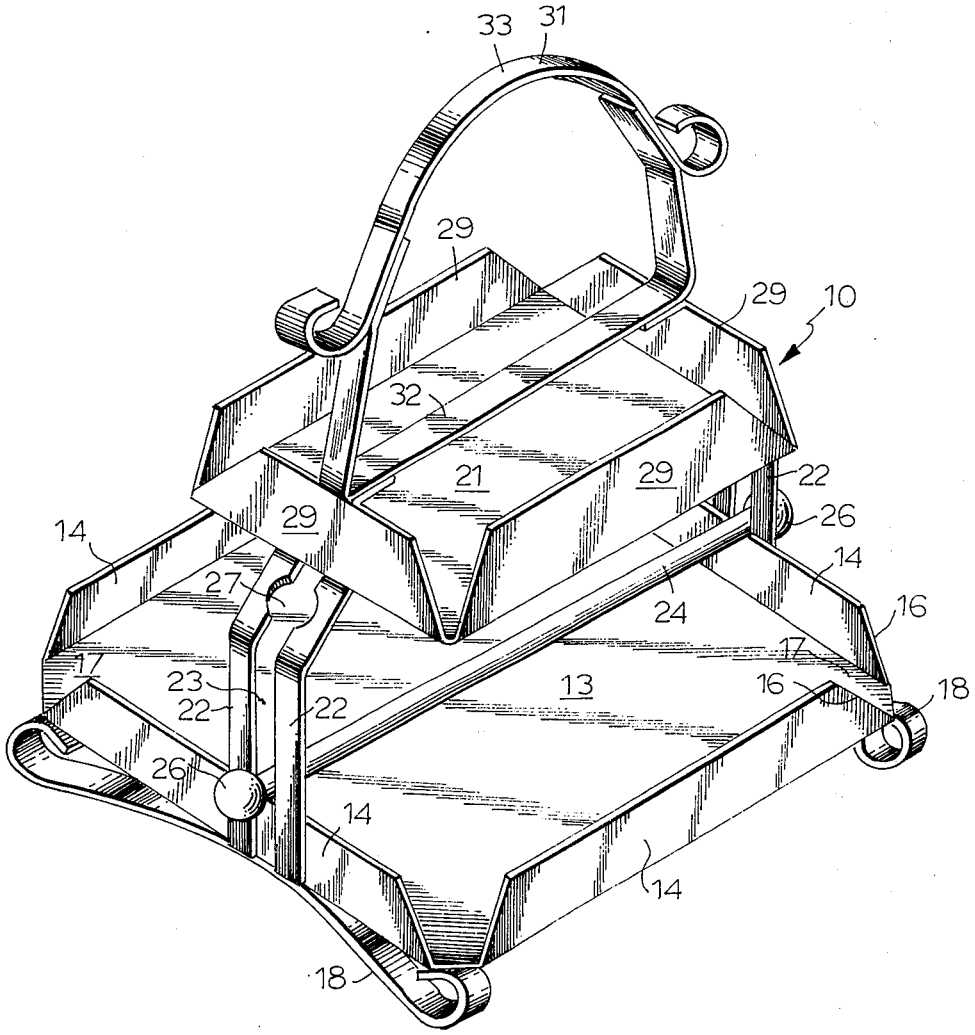
FIG. 1 is a perspective view of a container and napkin holder according to the instant invention.
Figure 2:
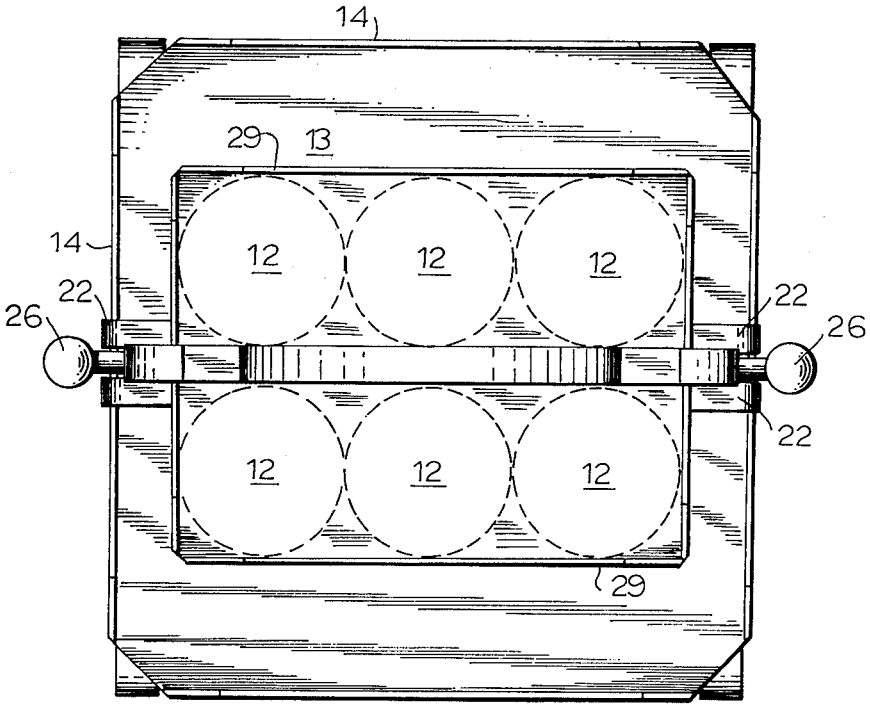
FIG. 2 is a top view of the container and napkin holder of the instant invention showing containers and napkins therein.
Figure 3:
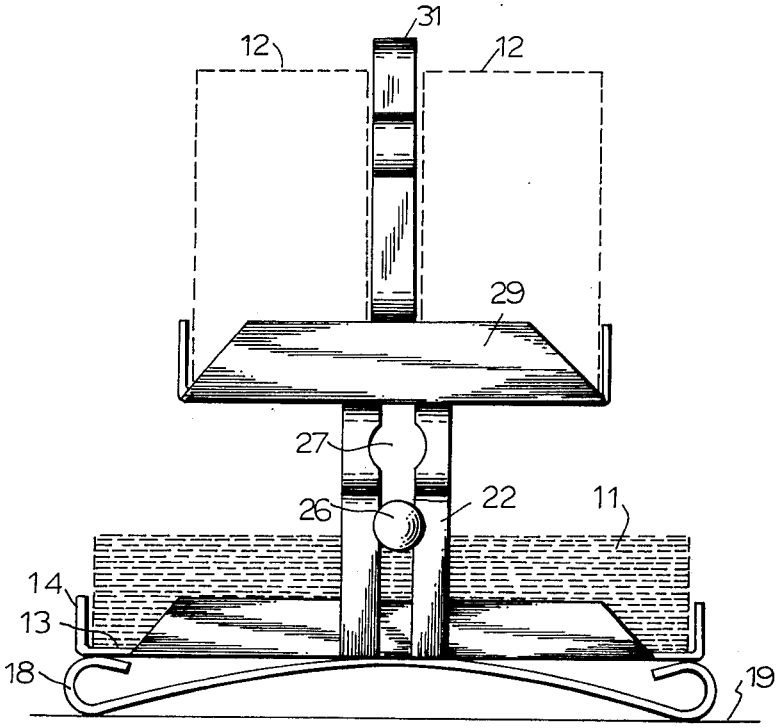
FIG. 3 is a side view of the container and napkin holder of FIG. 1 showing containers and napkins organized thereon.

Referring now to the drawings, there is shown a holder, designated generally by the numeral 10, for supporting and carrying napkins 11 and containers 12 thereon. The containers 12 are preferably cylindrical bottles containing condiments.

The napkins 11 are held in a lower tray 13 which has flanges 14—14 projecting upwardly from each side thereof. In order to provide ready access to the napkins 11 in the tray 13 when the stack of napkins is lower than the height of the flanges 14, the flanges are bevelled along edges 16 thereof to provide openings 17. In addition, the lower tray 13 has its corners sheared at the juncture of the edges 16 with the tray so that a person reaching into the opening 17 will not encounter a sharp projecting edge. A pair of skids 18—18 are provided beneath the lower tray 13 so that napkins 11 in the lower tray are held above the surface 19 of the table upon which the holder 10 rests.

The containers 12 are received on an upper tray 21 that is supported above the lower tray 13 by pairs of struts 22. The struts 22 are spaced apart to define a slot 23 in which is received a retaining bar 24 which serves as a weight to hold the napkins 11 in place. The retaining bar has enlarged ends 26 which have a cross-section which is wider than the slot 23 and are preferably cylindrical in configuration. The enlarged ends 26 prevent the bar 24 from becoming dislodged from the slots 23. Since it may be desirable to remove the bar 24 from the slots 23 for shipment of the holder 10, a wide portion 27 having an area greater than the cross-section of the enlarged portion 26 of the bar is provided at the top of each slot 23. The struts 22 preferably extend vertically for a distance greater than the thickness of a suitable stack of napkins 11 and then angle toward the upper tray 21. The wide portion 27 is preferably located in the angle section of the struts. By pressing down on the napkins 11, the retaining bar 24 cooperates with the flanges 14 to hold the napkins in place on the tray 13 so that they will not be readily blown away by wind or will not readily dislodge from the holder 10 when the holder is being carried.

The upper tray 21 is preferably rigidly secured to the struts 22 by welding, rivets or the like. Flanges 29 extend vertically from the upper tray 21 and, as seen in FIG. 4, engage the lower portion of the containers to positively hold the containers on the tray. Extending between two of the flanges 29 and preferably in the same direction as the bar 24 is a handle 31 which is higher than the tops of the containers 12—12. A divider 32 preferably extends across the upper tray 21 and cooperates with the flanges 29 to help positively hold the containers in place by also engaging the lower portion of the containers. As seen in FIG. 1, the handle 31 converges toward its highest point 33. Consequently, the handle engages the four containers located the corners of the upper tray 21 to provide a support near the top of these containers. These containers, in turn, also engage the two middle containers so that all of the containers are supported near their tops. With this arrangement, one may carry the holder 10 without worrying about dropping the containers 12—12 therefrom.

It is also possible to rotatably secure the upper tray 21 to the struts 22 by a conventional journalling means so that condiments in all of the containers are readily observable by rotating the upper tray 21 relative to the lower tray 13.

The afore-described embodiment of the invention provides a stable, attractive holder for condiment containers and napkins which is readily transportable. This embodiment, however, is only illustrative of applicants' invention, which should be limited only by the following claims.

What is claimed:

1. A substantially rigid structure for holding and dispensing condiment containers and napkins comprising:

a lower tray portion having a substantially planar surface for retaining a stack of napkins securely thereon;

strut means extending upwardly from opposed sides of said lower tray portion in rigid relation thereto:

slot means extending upwardly from said lower tray portion and within said strut means;

bar means extending through said slot means and slidable therein said bar means extending across said lower tray portion to rest on napkins and thereby hold said napkins in said lower tray portion, said bar means including locking means to retain said bar in said slot means;

an upper tray portion including a substantially planar surface for supporting containers and flange means for positively retaining containers on said surface;

means for mounting said upper tray portion on and above said strut means above said slot means, so that said planar surfaces of said lower and upper trays remain parallel, when said structure is carried and is at rest; and handle means extending from said upper tray portion for lifting and carrying said structure, said handle means cooperating with said flange means to support said containers.

2. The structure of claim 1, wherein the lower tray portion includes supports for holding said structure above any surface on which the structure rests.

3. The structure of claim 1, wherein the lower tray portion includes flange means extending upwardly therefrom which cooperate with said bar means to retain the napkins in place.

4. The structure of claim 1, wherein the locking means on said bar means comprises a pair of enlarged portions on opposite ends of the bar means and have cross-sections greater than the width of said slot means.

5. The structure of claim 4, wherein the slot means includes an opening spaced a distance from said lower tray means, wherein said distance is greater than the thickness of a stack of napkins, said opening having an area greater than the cross-sectional area of said enlarged portions so that said bar can be removably retained in said slot.

6. The structure of claim 1, further including a strut extending across said upper tray portion, wherein said strut divides said tray in half and cooperates with said flanges to hold said containers positively in said upper tray portion by engaging said containers.

* * * * *